US007328814B2

(12) United States Patent
Nordland et al.

(10) Patent No.: US 7,328,814 B2
(45) Date of Patent: Feb. 12, 2008

(54) POLYMERIC CONTAINERS WITH HANDLE

(75) Inventors: Kate E. Nordland, Rochester, NY (US); Terry W. Cratsley, Honeoye, NY (US)

(73) Assignee: Pactiv Corporation, Lake Forest, IL (US)

( * ) Notice: Subject to any disclaimer, the term of this patent is extended or adjusted under 35 U.S.C. 154(b) by 369 days.

(21) Appl. No.: 10/689,308

(22) Filed: Oct. 20, 2003

(65) Prior Publication Data

US 2005/0082293 A1 Apr. 21, 2005

(51) Int. Cl.
*B65D 81/24* (2006.01)
*B65D 90/00* (2006.01)
*B65D 1/00* (2006.01)

(52) U.S. Cl. ..... 220/756; 220/902; 229/406

(58) Field of Classification Search ..... 220/756, 220/902, 9, 15.2, 592.2, 5, 6, 212.5, 826, 220/833, 835, 839, 645.1; 209/406
See application file for complete search history.

(56) References Cited

U.S. PATENT DOCUMENTS

| | | | | | |
|---|---|---|---|---|---|
| 1,011,752 | A | | 12/1911 | Cowlishaw | |
| 2,007,810 | A | * | 7/1935 | Oman | 229/117.15 |
| 2,496,619 | A | | 2/1950 | Cunningham, Jr. | |
| 2,844,299 | A | | 7/1958 | Kessler et al. | |
| 3,150,769 | A | | 9/1964 | Cohn | |
| 3,640,380 | A | | 2/1972 | Huffman | |
| 3,933,296 | A | * | 1/1976 | Ruskin et al. | 229/406 |
| 4,397,393 | A | | 8/1983 | Pergande et al. | |
| D273,941 | S | | 5/1984 | Farber | |
| 4,546,914 | A | | 10/1985 | Roccaforte | |
| 4,678,079 | A | | 7/1987 | Henning | |
| 4,917,290 | A | | 4/1990 | Saiki et al. | |
| 5,074,460 | A | * | 12/1991 | Hanekamp | 229/117 |
| 5,106,882 | A | * | 4/1992 | Suh et al. | 521/79 |
| 5,248,081 | A | | 9/1993 | Hook | |
| 5,392,984 | A | | 2/1995 | Yocum | |
| D367,816 | S | * | 3/1996 | Cai | D9/431 |
| 5,685,478 | A | * | 11/1997 | Tang | 229/117.14 |
| 5,816,484 | A | * | 10/1998 | Buchalski et al. | 229/117.15 |
| 5,897,051 | A | | 4/1999 | Tessier et al. | |
| 6,036,085 | A | | 3/2000 | Tsao | |
| 6,131,803 | A | | 10/2000 | Oliff et al. | |
| D442,859 | S | | 5/2001 | Hirschey | |
| D466,805 | S | | 12/2002 | Radvansky | |

(Continued)

*Primary Examiner*—Anthony D. Stashick
*Assistant Examiner*—Shawn M. Braden
(74) *Attorney, Agent, or Firm*—Baker Botts L.L.P.

(57) ABSTRACT

A polymeric container comprises a continuous body portion, a rim, first and second minor flaps, and first and second major flaps. The body portion is integrally-formed and non-foldable. The rim encompasses and projects laterally outwardly from the continuous body portion. The first and second minor flaps are integrally connected to the rim along respective fold lines. The minor flaps form respective first and second minor flap securing portions. The first and second major flaps are integrally connected to the rim along respective fold lines. The major flaps form respective openable handle portions or handle openings therein, respective first end securing portions, and respective second end securing portions. The second openable handle portion or second handle opening is adapted to generally align with the first openable handle portion or first handle opening to form a handle. The first minor flap securing portion secures two end securing portions, and the second minor flap securing portion secures two other end securing portions.

34 Claims, 4 Drawing Sheets

U.S. PATENT DOCUMENTS

D470,767 S 2/2003 Meyer et al.
6,666,348 B2 * 12/2003 Fore et al. ..... 220/4.21
6,837,420 B2 * 1/2005 Westerman et al. .... 229/117.15

* cited by examiner

POLYMERIC CONTAINERS WITH HANDLE

FIELD OF INVENTION

The present invention relates generally to containers. More particularly, the present invention relates to polymeric containers with handles and methods of forming the same.

BACKGROUND OF THE INVENTION

The use of inexpensive polymeric containers, such as alkenyl aromatic polymeric containers, has become popular, especially for preparing and serving various food products. These containers generally have been used for heating and storing the food product(s) disposed therein. These containers typically comprise a cover or lid and a base.

It would be desirable to have a polymeric container that would be easy for the customer to close and open. It would also be desirable to provide a container that prevents or inhibits material, such as liquid, from leaving the container. It would also be desirable to provide a container that is easy to carry.

SUMMARY OF THE INVENTION

According to one embodiment, a polymeric container comprises a continuous body portion, a rim, first and second minor flaps, and first and second major flaps. The continuous body portion is integrally-formed and non-foldable. The rim encompasses and projects laterally outwardly from the continuous body portion. The first minor flap is integrally connected to the rim along a first fold line. The first minor flap forms a first minor flap securing portion. The second minor flap is integrally connected to the rim along a second fold line and located opposite of the first minor flap. The second minor flap forms a second minor flap securing portion. The first major flap is integrally connected to the rim along a third fold line.

The first major flap forms a first openable handle portion or first handle opening therein, a first end securing portion, and a second end securing portion. The second major flap is integrally connected to the rim along a fourth fold line and located opposite of the first major flap. The second major flap forms a second openable handle portion or second handle opening therein, a third end securing portion, and a fourth end securing portion. The second openable handle portion or second handle opening of the second major flap is adapted to generally align with the first openable handle portion or first handle opening of the first major flap so as to form a handle when the container is in a closed position. The first minor flap securing portion secures the first and third end securing portions, and the second minor flap securing portion secures the second and fourth end securing portions.

According to another embodiment, a polymeric container comprises a continuous body portion, first and second minor flaps, and first and second major flaps. The continuous body portion is integrally-formed and non-foldable. The body portion comprises a bottom and a sidewall encompassing and projecting upwardly from the bottom. The first minor flap is integrally connected to the sidewall along a first fold line. The first minor flap forms a first minor flap securing portion. The second minor flap is integrally connected to the sidewall along a second fold line and located opposite of the first minor flap. The second minor flap forms a second minor flap securing portion.

The first major flap is integrally connected to the sidewall along a third fold line. The first major flap forms a first openable handle portion or first handle opening therein, a first end securing portion, and a second end securing portion. The second major flap is integrally connected to the sidewall along a fourth fold line and located opposite of the first major flap. The second major flap forms a second openable handle opening or second handle opening therein, a third end securing portion, and a fourth end securing portion. The second openable handle portion or second handle opening of the second major flap is adapted to generally align with the first openable handle portion or first handle opening of the first major flap so as to form a handle when the container is in a closed position. The first minor flap securing portion secures the first and third end securing portions, and the second minor flap securing portion secures the second and fourth end securing portions.

According to a further embodiment, a polymeric container comprises a body portion, a rim, first and second minor flaps, and first and second major flaps. The body portion is integrally-formed and non-foldable. The rim encompasses and projects laterally outwardly from the continuous body portion. The first minor flap is integrally connected to the rim along a first fold line. The first minor flap forms a first minor flap securing portion. The second minor flap is integrally connected to the rim along a second fold line and located opposite of the first minor flap. The second minor flap forms a second minor flap securing portion. The second minor flap is substantially identical to the first minor flap.

The first major flap is integrally connected to the rim along a third fold line. The first major flap forms a first openable handle portion or first handle opening therein, a first end securing portion, and a second end securing portion. The second major flap is integrally connected to the rim along a fourth fold line and located opposite of the first major flap. The second major flap forms a second openable handle portion or second handle opening therein, a third end securing portion, and a fourth end securing portion. The second openable handle portion or second handle opening of the second major flap is adapted to generally align with the first openable handle portion or first handle opening of the first major flap so as to form a handle when the container is in a closed position. The second major flap is substantially identical to the first major flap. The first minor flap securing portion secures the first and third end securing portions, and the second minor flap securing portion secures the second and fourth end securing portions.

According to yet another embodiment, a polymeric container comprises a body portion, first and second minor flaps, and first and second major flaps. The body portion is integrally-formed and non-foldable. The body portion comprises a bottom and a sidewall encompassing and projecting upwardly from the bottom. The first minor flap is integrally connected to the sidewall along a first fold line. The first minor flap forms a first minor flap securing portion. The second minor flap is integrally connected to the sidewall along a second fold line and located opposite of the first minor flap. The second minor flap forms a second minor flap securing portion. The second minor flap is substantially identical to the first minor flap.

The first major flap is integrally connected to the sidewall along a third fold line. The first major flap forms a first openable handle portion or first handle opening therein, a first end securing portion, and a second end securing portion. The second major flap is integrally connected to the sidewall along a fourth fold line and located opposite of the first major flap. The second major flap forms a second openable handle portion or second handle opening therein, a third end securing portion, and a fourth end securing portion. The second openable handle portion or second handle opening of the second major flap is adapted to generally align with the first openable handle portion or first handle opening of the first major flap so as to form a handle when the container is in a closed position. The second major flap is substantially identical to the first major flap. The first minor flap securing portion secures the first and third end securing portions, and the second minor flap securing portion secures the second and fourth end securing portions.

According to one process, a polymeric container is formed. The provided polymeric container comprises a continuous body portion, a rim, a first minor flap, a second minor flap, a first major flap, and a second major flap. The continuous body portion is integrally-formed and non-foldable. The rim encompasses and projects laterally outwardly from the continuous body portion. The first minor flap is integrally connected to the rim along a first fold line. The first minor flap forms a first minor flap securing portion. The second minor flap is integrally connected to the rim along a second fold line and located opposite of the first minor flap. The second minor flap forms a second minor flap securing portion. The first major flap is integrally connected to the rim along a third fold line. The first major flap forms a first openable handle portion or first handle opening therein, a first end securing portion, and a second end securing portion. The second major flap is integrally connected to the rim along a fourth fold line and located opposite of the first major flap. The second major flap forms a second openable handle portion, or second handle opening therein, a third end securing portion, and a fourth end securing portion.

The first major flap and the second major flap are folded upwardly and inwardly to the approximate middle of the container such that the second openable handle portion or second handle opening of the second major flap is generally aligned with the first openable handle portion or first handle opening of the first major flap so as to form a handle when the container is in a closed position. The first minor flap and the second minor flap are folded upwardly and inwardly toward the first and second major flaps. The first minor flap securing portion is pressed over and into the first and third end securing portions. The second minor flap securing portion is pressed over and into the second and fourth end securing portions.

According to another process, a polymeric container is formed. The provided polymeric container comprises a body portion, a first minor flap, a second minor flap, a first major flap, and a second major flap. The body portion is integrally-formed and non-foldable. The body portion comprises a bottom and a sidewall encompassing and projecting upwardly from the bottom. The first minor flap is integrally connected to the sidewall along a first fold line. The first minor flap forms a first minor flap securing portion. The second minor flap is integrally connected to the sidewall along a second fold line and located opposite of the first minor flap. The second minor flap forms a second minor flap securing portion. The first major flap is integrally connected to the sidewall along a third fold line. The first major flap forms a first openable handle portion or first handle opening therein, a first end securing portion, and a second end securing portion. The second major flap is integrally connected to the sidewall along a fourth fold line and located opposite of the first major flap. The second major flap forms a second openable handle portion or second handle opening therein, a third end securing portion, and a fourth end securing portion.

The first major flap and the second major flap are folded upwardly and inwardly to the approximate middle of the container such that the second openable handle portion or second handle opening of the second major flap is generally aligned with the first openable handle portion or first handle opening of the first major flap so as to form a handle when the container is in a closed position. The first minor flap and the second minor flap are folded upwardly and inwardly toward the first and second major flaps. The first minor flap securing portion is pressed over and into the first and third end securing portions. The second minor flap securing portion is pressed over and into the second and fourth end securing portions.

According to another embodiment, a polymeric container comprises a body portion, rim, first and second minor flaps, and first and second major flaps. The container has an integrally-formed, non-foldable, continuous body portion. The rim encompasses and projects laterally outwardly from the continuous body portion. The first minor flap is integrally connected to the rim along a first fold line. The second minor flap is integrally connected to the rim along a second fold line and located opposite of the first minor flap. The first major flap is integrally connected to the rim along a third fold line. The first major flap forms a first openable handle portion or first handle opening therein. The second major flap is integrally connected to the rim along a fourth fold line and located opposite of the first major flap. The second major flap forms a second openable handle portion or second handle opening therein. The second openable handle portion or second handle opening of the second major flap is adapted to generally align with the first openable handle portion or first handle opening of the first major flap so as to form a handle when the container is in a closed position.

According to a further embodiment, a polymeric container comprises a body portion, first and second minor flaps, and first and second major flaps. The container has an integrally-formed, non-foldable, body portion. The body portion comprises a bottom and a sidewall encompasses and projects upwardly from the bottom. The first minor flap is integrally connected to the sidewall along a first fold line. The second minor flap is integrally connected to the sidewall along a second fold line and located opposite of the first minor flap. The first major flap is integrally connected to the sidewall along a third fold line. The first major flap forms a first openable handle portion or first handle opening therein. The second major flap is integrally connected to the sidewall along a fourth fold line and located opposite of the first major flap. The second major flap forms a second openable handle opening or second handle opening therein. The second openable handle portion or second handle opening of the second major flap is adapted to generally align with the first openable handle portion or first handle opening of the first major flap so as to form a handle when the container is in a closed position.

Figure 1:
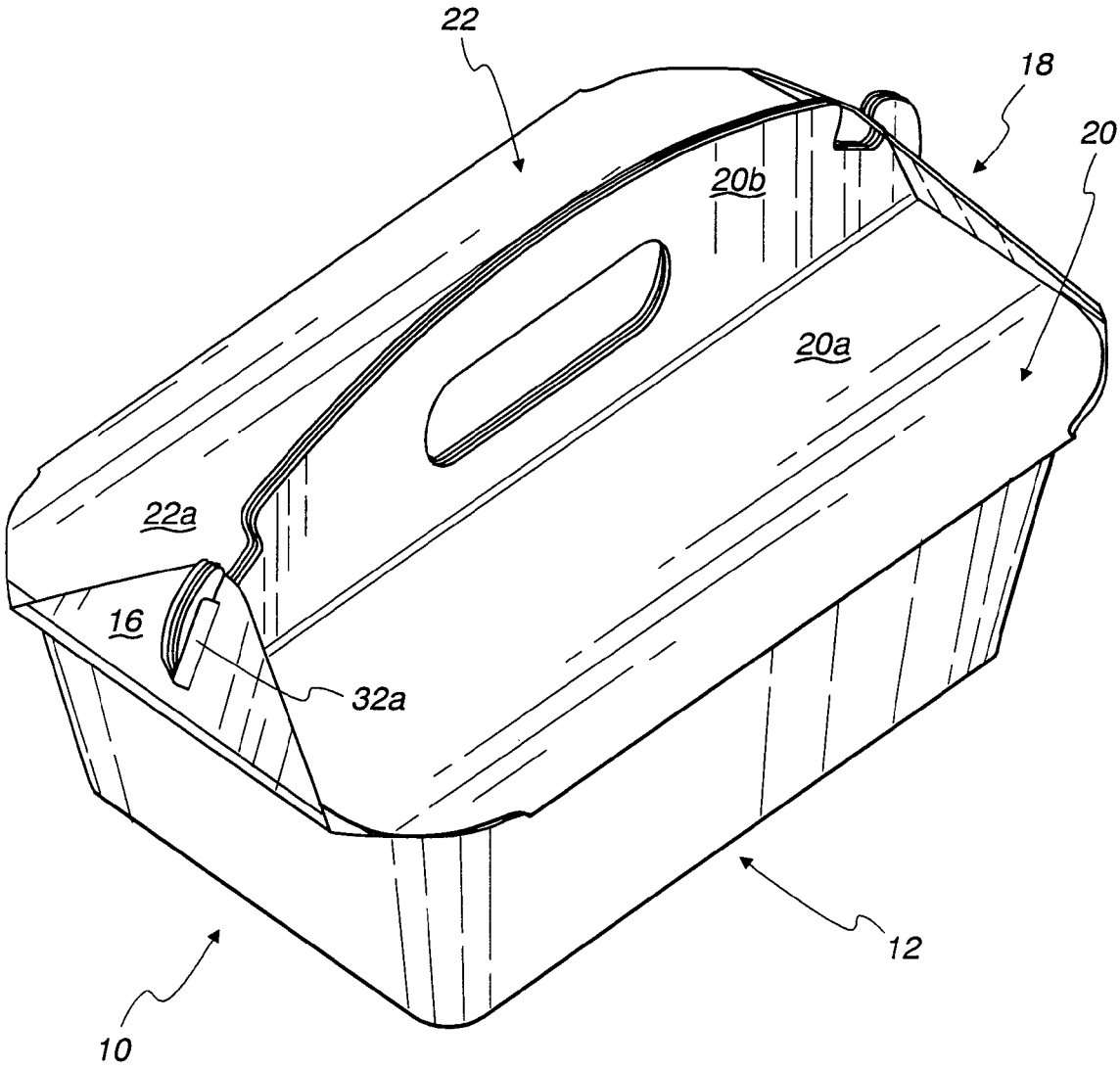
FIG. 1 is a perspective view of a container in a closed position according to one embodiment of the present invention.
Figure 2:
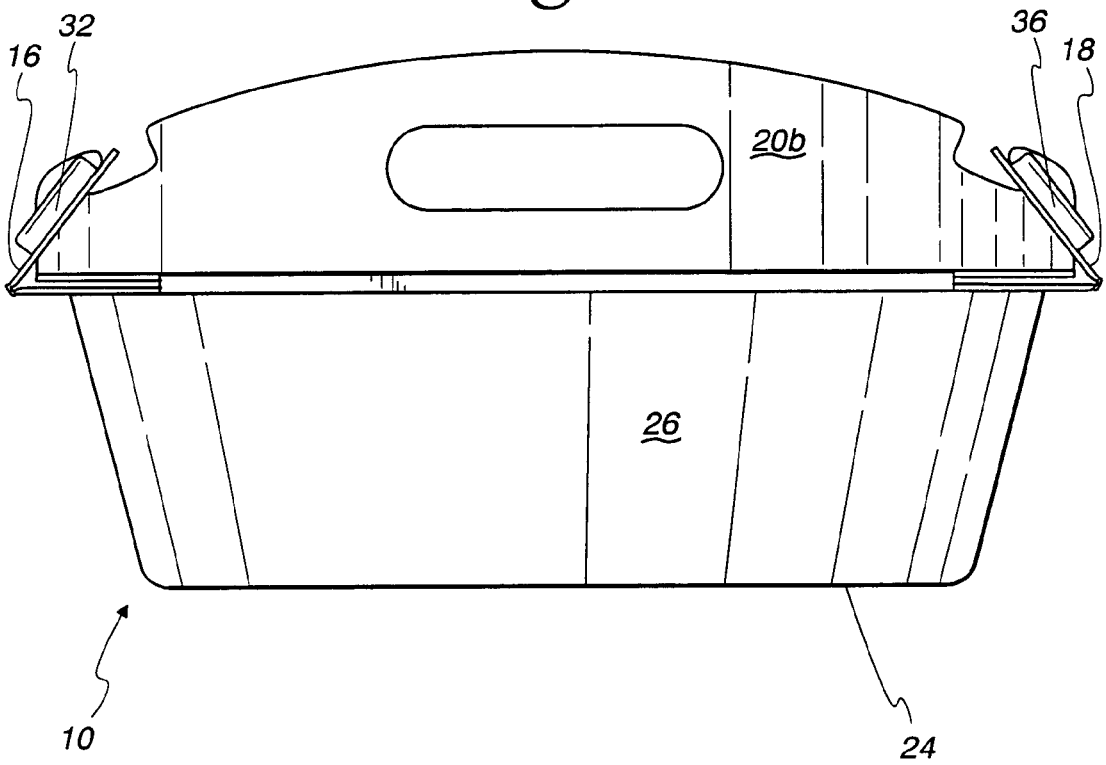
FIG. 2 is a side view of the container of FIG. 1.
Figure 3:
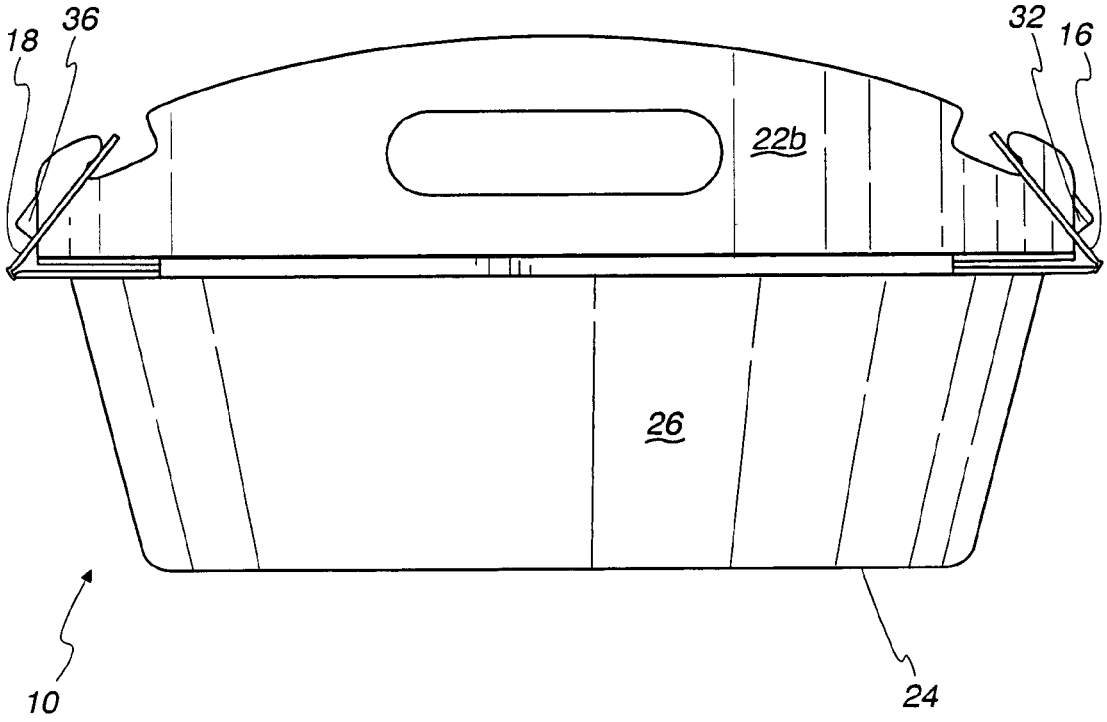
FIG. 3 is an opposing side view of the container of FIG. 2.

While the invention is susceptible to various modifications and alternative forms, a specific embodiment thereof has been shown by way of example in the drawing and will herein be described in detail. It should be understood, however, that it is not intended to limit the invention to the particular form disclosed but, on the contrary, the intention is to cover all modifications, equivalents, and alternatives falling within the spirit and scope of the invention as defined by the appended claims.

DESCRIPTION OF ILLUSTRATIVE EMBODIMENTS

Referring to FIGS. 1-6, a container 10 of the present invention is depicted. The height and shape of the container may vary from that shown without departing from the scope of the invention. For example, the container 10 is shown as being generally rectangular, but it is contemplated that other shapes like a square or other polygonal shapes may be used.

The container of the present invention is typically used to hold food, but may be used in other applications such as with medical applications, cosmetics, craft supplies or other items. The food container may be used for serving, storing, preparing and/or re-heating the food such as pre-packed meals. The container of the present invention may have insulating properties to assist in maintaining the temperature of any food contained therein. One example of such a container is an alkenyl aromatic container.

Referring specifically to FIGS. 1-4, the container 10 includes a continuous body portion 12, a continuous rim 14, a first minor flap 16, a second minor flap 18, a first major flap 20 and a second major flap 22. The first minor flap 16, the second minor flap 18, the first major flap 20 and the second major flap 22 are adapted to fold together to form a closed container with a handle.

According to this embodiment, the first and second minor flaps 16, 18 are identical to each other. It is contemplated that the first and second minor flaps may be substantially identical to each other, although it is not necessary that the first and second minor flaps be either substantially identical or identical with each other.

According to this embodiment, the first and second major flaps 20, 22 are identical to each other. It is contemplated that the first and second major flaps may be substantially identical to each other, although it is not necessary that the first and second major flaps be either substantially identical or identical with each other.

The body portion 12 includes a bottom 24 and a sidewall 26 that encompasses and projects upwardly and outwardly from the bottom 24. It is contemplated that the sidewall may project only upwardly from the bottom. To provide enhanced carrying strength, the continuous body portion 12 is integrally-formed (i.e., solid) and is not formed by folding the sidewall with respect to the bottom. Thus, the continuous body portion 12 is non-foldable. The integrally-formed, non-foldable continuous body portion 12 also assists in preventing or inhibiting leakage therefrom. The bottom and/or sidewall may include ribs for additional carrying strength.

The continuous rim 14 encompasses and projects laterally outwardly from the body portion 12. The rim, however, may be discontinuous, although it is preferred to be continuous. The rim is advantageous for a number of reasons including providing supporting strength when the container is being placed in the closed position. Additionally, the process of making the container, such as by thermoforming, is made easier by using a rim. According to another embodiment, the container may be formed without a rim. In such an embodiment, the minor flaps and the major flaps are integrally connected to the sidewall along respective fold lines.

The first minor flap 16 is integrally connected to the rim 14 along a first fold line 30. The first minor flap 16 is shown as being generally triangular in shape. It is contemplated, however, that the first minor flap may be shaped differently.

The first minor flap 16 forms a hinged opening or slot 32 to assist in securing the first and second major flaps 20, 22 to the first minor flap 16 when the container is in a closed position. The hinged opening 32 may be formed by, for example, a knife cut or a perforated cut. The hinged opening 32 is shown in its closed position in FIG. 4 and is shown in an open position in FIGS. 1-3 and 5. The hinged opening 32 receives a portion of the first and second major flaps 20, 22 when the container is in the closed position. (FIGS. 1-3 and 5). The hinged opening 32 may be shaped differently than the rectangular shape depicted in FIGS. 1, 2, 4 and 5. For example, the hinged opening of the first minor flap may be oval, circular, or other polygonal shapes. The hinged opening may have a length of from about ¾ inch to about 3 inches according to one embodiment.

The hinged opening may be formed by having two pivoting pieces. In one embodiment of a two piece hinged opening, the hinges are located on opposing sides and each piece extends to the approximate middle of the opening to be formed. In this embodiment, each of the two pieces that form the hinged opening is about the same size. Alternatively, the two pieces that form the two piece hinged opening may be sized differently.

According to another embodiment, the first minor flap forms an opening to receive a portion of the first and second major flaps 20, 22. The opening may be shaped like the opening formed by the hinged opening 32 (i.e., rectangular). It is contemplated that the opening may be shaped differently, such as oval, circular or other polygonal shapes. It is also contemplated that the first minor flap may form a perforated cutout that is removable by the user to form an opening. The perforated cutout may be removed before or when placing the container in a closed position. The perforated cutout may be shaped the same as described above with respect to the opening of the first minor flap.

Similarly, the second minor flap 18 is integrally connected to the rim 14 along a second fold line 34 (FIG. 4) and located opposite of the first minor flap 16. The second minor flap 18 is shown as being generally triangular in shape. It is contemplated that the second minor flap may be shaped differently. It is also contemplated that the first and second minor flaps may be shaped differently.

The second minor flap 18 forms a hinged opening or slot 36 to assist in securing the first and second major flaps 20, 22 to the second minor flap 18 when the container is in a closed position. The hinged opening 36 may be formed by, for example, a knife cut or a perforated cut. The hinged opening 36 is shown in its closed position in FIG. 4 and is shown in an open position in FIGS. 1-3 and 6. The hinged opening 36 receives a portion of the first and second major flaps 20, 22 when the container is in the closed position (FIGS. 1-3 and 6). The hinged opening 36 may be shaped differently than the rectangular shape depicted in FIGS. 1, 3, 4 and 6. For example, the hinged slot of the second minor flap may be oval, circular, or other polygonal shapes.

According to another embodiment, the second minor flap forms an opening to receive a portion of the first and second major flaps 20, 22. The opening may be shaped like the opening formed by the hinged opening 36 (i.e., rectangular). It is contemplated that the opening may be shaped differently, such as oval, circular or other polygonal shapes. It is also contemplated that the second minor flap may form a perforated cutout that is removable by the user to form an opening. The perforated cutout may be removed before or when placing the container in a closed position. The perforated cutout may shaped the same as described above with respect to the opening of the second minor flap.

Referring back to FIG. 4, the first major flap 20 is integrally connected to the rim 14 along a third fold line 50. The first major flap 20 forms a first handle opening 52 that is adapted to form a handle when the container 10 is in a closed position. The first handle opening 52 may be formed by a knife cut or an absence of material. In such an embodiment, the user does not need to remove any material before forming the handle.

The first handle opening 52 may be formed by a perforated opening that is removed by a user. The perforated handle opening may be removed by punching out the material. Alternatively, the first opening may be formed by a hinged opening or slot that is movable to an open position. The perforated handle opening and hinged handle opening of the first major flap that are adapted to assist in forming a handle are referred herein as openable handle portions. The shape of the first handle opening 52 may be different than depicted in FIGS. 1 and 4, as long as the desired shape can function as a handle for carrying the container 10 in its closed position. Similarly, the perforated handle opening or hinged handle opening of the first major flap may be formed with similar shapes as the first handle opening 52.

The first major flap 20 also forms a first cutout or hook 54 and a second cutout or hook 56 at its respective ends. As shown in FIGS. 1-6, the first cutout 54 is adapted to receive and hold the hinged opening 32, while the second cutout 56 is adapted to receive and hold the hinged opening 36. The first cutout 54 and the second cutout 56 may be shaped differently than depicted in FIGS. 1-4.

It is contemplated that the first major flap 20 may have perforated and/or hinged openings or slots that are adapted to receive and hold a respective one of the first and second minor flaps 16, 18. It is also contemplated that the major flaps may be secured to the minor flaps with the use of protrusions from the major flap. The protrusions may extend outwardly from the remainder of the periphery of the major flap. It is contemplated that the protrusions may be made of different shapes to assist in securing to the minor flaps. The protrusions are typically located at or near opposing sides of the major flaps so as to secure respective minor flaps.

It is also contemplated that the first major flap may have a combination of cutouts, perforated openings, hinged openings or outward protrusions that are adapted to receive and hold a respective one of the first and second minor flaps 16, 18.

The first major flap 20 also includes a fold line 58 to assist in forming the container 10. The fold line 58 extends generally along a major axis of the first major flap 20. The fold line 58 may be formed by perforations or score lines. The fold line 58 may be formed by using, for example, hinge knives. The fold line 58 divides the first major flap 20 into a first section 20*a* and a second section 20*b*.

The second major flap 22 is integrally connected to the rim 14 along a fourth fold line 70. The second major flap 22 forms a second handle opening 72 that generally aligns with the first handle opening 52 to form a handle when the container 10 is in a closed position. The second handle opening 72 may be formed by a knife cut or an absence of material. In such an embodiment, the user does not need to remove any material before forming the handle.

The second handle opening 72 may be formed by a perforated opening that is removed by a user. The perforated opening may be removed by punching out the material. Alternatively, the second opening may be formed by a hinged handle opening or slot that is movable to an open position. The perforated handle opening and hinged handle opening of the second major flap that are adapted to assist in forming a handle are referred herein as openable handle slots. The shape of the second handle opening 72 may be different than depicted in FIGS. 1 and 4, as long as the desired shape can function as a handle for carrying the container 10 in its closed position. Similarly, the perforated handle opening or hinged handle opening of the second major flap may be formed with similar shapes as the second handle opening 72.

The second major flap 22 also forms a first cutout or hook 74 and a second cutout or hook 76 at its respective ends. As shown in FIGS. 1-6, the first cutout 74 is adapted to receive and hold the hinged opening 32, while the second cutout 76 is adapted to receive and hold the hinged opening 36. The first cutout 74 and the second cutout 76 may be shaped differently than depicted in FIGS. 1-4.

It is contemplated that the second major flap 22 may have perforated and/or hinged opening or slots that are adapted to receive and hold a respective one of the first and second minor flaps 16, 18. It is also contemplated that the major flaps may be secured to the minor flaps with the use of protrusions from the major flap. The protrusions may extend outwardly from the remainder of the periphery of the major flap. It is contemplated that the protrusions may be made of different shapes to assist in securing to the minor flaps. The protrusions are typically located at or near opposing sides of the major flaps so as to secure respective minor flaps.

It is also contemplated that the second major flap may have a combination of cutouts, perforated openings, hinged openings or outward protrusions that are adapted to receive and hold a respective one of the first and second minor flaps 16, 18.

The second major flap 22 also includes a fold line 78 to assist in forming the container 10. The fold line 78 extends generally along a major axis of the second major flap 22. The fold line 78 may be formed by perforations or score lines. The fold line 78 divides the second major flap 22 into a first section 22*a* and a second section 22*b*.

Figure 4:
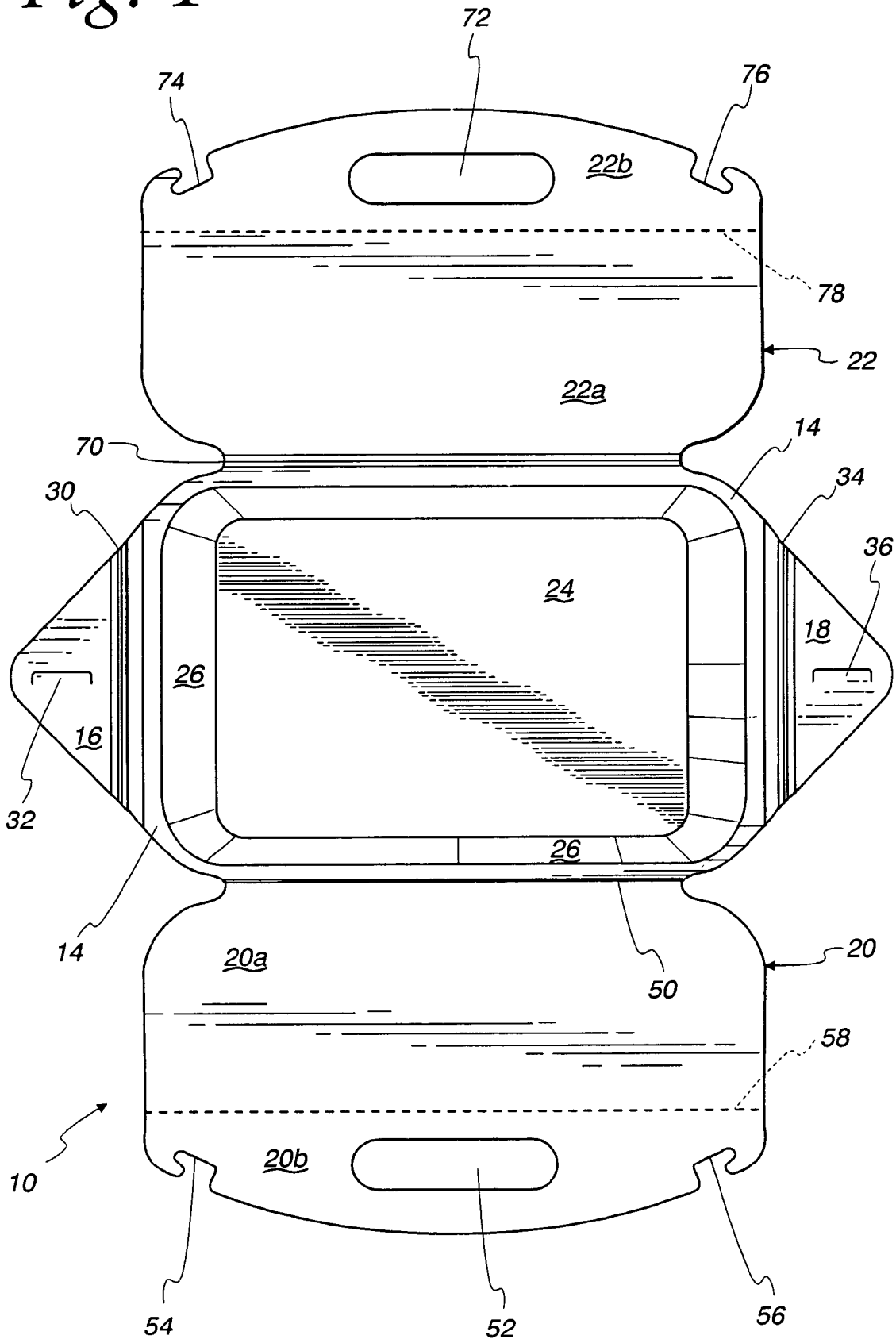
FIG. 4 is a top view of the container of FIG. 1 in an open position.
Figure 5:
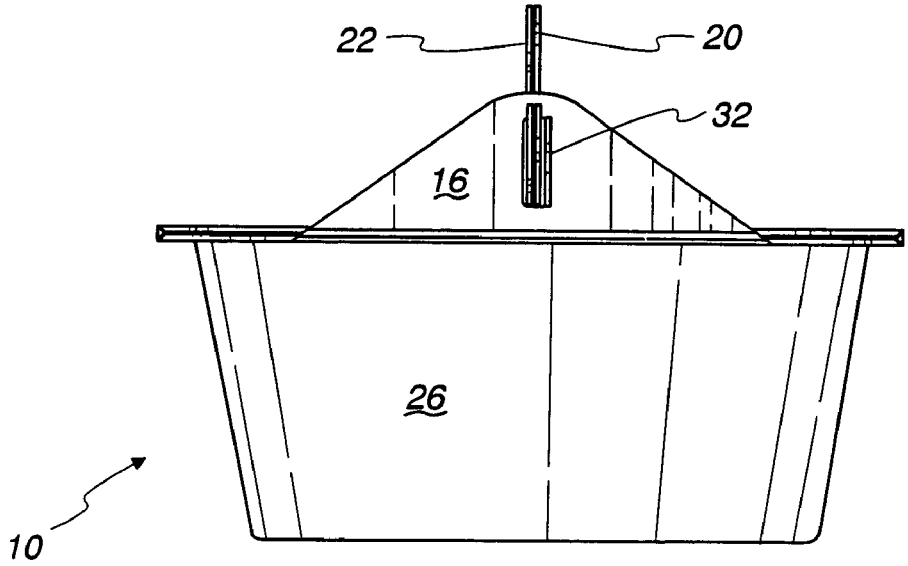
FIG. 5 is an end view of the container of FIG. 1.
Figure 6:
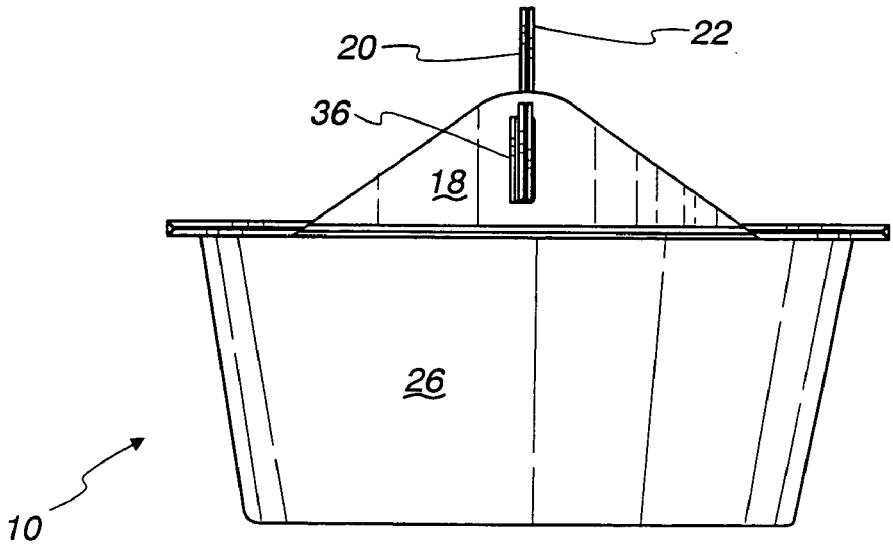
FIG. 6 is an opposing end view of the container of FIG. 5.

To close the container 10 from the open position of FIG. 4 to the closed position of FIG. 1, the minor flaps 16, 18 and the major flaps 20, 22 are folded upwardly and inwardly. According to one method, the major flaps 20, 22 are first folded upwardly and inwardly. As shown in FIG. 1, the major flaps 20, 22 meet in the approximate middle of the major axis of the container. The first handle opening 52 and second handle opening 72 generally align with each other in the closed position so as to form a handle for carrying the container 10. Depending on the embodiment, the first and/or second handle opening may need to be punched out by a user to form the handle. In the closed position, the first section 20*a* is generally parallel to and in the same plane as the rim 14, while the second section 20*b* extends upwardly from the first section 20*a*. A portion of the first section 20*a* rests on the rim 14 when the container 10 is in the closed position.

As shown in FIG. 1, the second section 20*b* of the major flap 20 is generally perpendicular to the first section 20*a*. Similarly, the first section 22*a* of the major flap 22 is generally parallel with the rim 14, while the second section 22*b* extends upwardly from the first section 22*a*. As shown in FIG. 1, the second section 20*b* is generally perpendicular to the first section 20*a*. It is contemplated that the first sections of the first and second major flaps may not necessarily be generally parallel to the rim 14 when the container 10 is in the closed position. It is also contemplated that the second sections of the first and second major flaps may not necessarily be generally perpendicular to their respective first sections when the container 10 is in the closed position.

According to this process, the first and second minor flaps 16, 18 are folded upwardly and inwardly. The hinged opening 32 of the first minor flap 16 is then folded and pressed over and into cutouts 54, 74 as depicted in FIGS. 1-3 and 5. Similarly, the hinged opening 36 of the second minor flap 18 is folded over and pressed into cutouts 56, 76 as depicted in FIGS. 1-3 and 6.

The polymeric container 10 of the present invention may comprise an alkenyl aromatic polymer. The term "alkenyl aromatic polymer" as used herein includes polymers of aromatic hydrocarbon molecules that contain an aryl group joined to an olefinic group with only double bonds in the linear structure, such as styrene, α-methylstyrene, o-methylstyrene, m-methylstyrene, p-methylstyrene, α-ethlystyrene, α-vinylxylene, α-chlorostyrene, α-bromostyrene, and vinyl toluene. Alkenyl aromatic polymers also include homopolymers of styrene (commonly referred to as polystyrene), copolymers of styrene and butadiene, and rubber-toughened polystyrene (commonly referred to as high impact polystyrene or HIPS). The alkenyl aromatic polymer may be an oriented polystyrene (OPS).

The polymeric container may be formed from polyolefins (e.g., polypropylene and high density polyethylene (HDPE)), polyethylene terephthalate (PET), polyvinyl chloride (PVC), and combinations thereof. The polymeric container may be made from a mineral-filled polymeric material such as, for example, talc or calcium carbonate-filled polyolefin. The polymeric container may be a foam such an alkenyl aromatic polymer described above or a polyolefin foam.

The polymeric container of the present invention is typically disposable, but it is contemplated that it may be reused at a future time. As shown in FIG. 4, the container 10 includes one compartment. It is contemplated that the containers may be formed of multiple compartments. Such containers are desirable for placing items (e.g., food items) in different compartments to prevent or inhibit commingling of items. For example, undesirable mixing of food items can corrupt the flavor and the consistency of the food items.

As discussed above, the polymeric container may be used with food items. A method of using such a container includes placing the food therein and then placing the container in a heating apparatus, such as a microwave, to heat the food. The container may contain solid food products. The container may be used for storage in the refrigerator and/or the freezer.

The polymeric container may be formed using conventional thermoforming (e.g., by pressure, vacuum or the combination thereof), or injection-molding processes. According to one method of thermoforming, pellets of a polymeric such as an alkenyl aromatic polymer resin and additives, if any, are added into an extruder. The pellets of the alkenyl aromatic polymeric resin and additives, if any, are melted to form a blend. The blend is extruded through a die to form an extruded sheet. The extruded sheet is thermoformed to a desired shape of a container.

The thickness of the polymeric container generally ranges from about 50 to about 150 mils, but is typically from about 70 to about 100 mils. The container may be opaque or a variety of colors or color combinations. If it is desired for the customer to ascertain the nature of the accommodated product and the condition thereof without having to open the container, the container may be at least generally transparent.

While a particular embodiment and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A polymeric container, comprising:

an integrally-formed, non-foldable, continuous body portion including a bottom and a sidewall projecting upwardly from the bottom to a top edge, the top edge defining an opening;

a rim encompassing the opening and projecting laterally outwardly from the top edge of the sidewall;

a first minor flap integrally connected to the rim along a first fold line, the first minor flap forming a first minor flap securing portion;

a second minor flap integrally connected to the rim along a second fold line and located opposite of the first minor flap, the second minor flap forming a second minor flap securing portion;

a first major flap integrally connected to the rim along a third fold line, the first major flap forming a first openable handle portion or first handle opening therein, a first end securing portion, and a second end securing portion; and a second major flap integrally connected to the rim along a fourth fold line and located opposite of the first major flap, the second major flap forming a second openable handle portion or second handle opening therein, a third end securing portion, and a fourth end securing portion, the second openable handle portion or second handle opening of the second major flap being adapted to generally align with the first openable handle portion or first handle opening of the first major flap so as to form a handle when the container is in a closed position, wherein the first minor flap securing portion secures the first and third end securing portions, and the second minor flap securing portion secures the second and fourth end securing portions, and wherein the container is a polymeric container.

2. The container of claim 1, wherein the first major flap forms a first openable handle portion and the second major flap forms a second openable handle portion, the first and second openable handle portions are adapted to be removed so as to form a handle when the container is in a closed position.

3. The container of claim 1, wherein the first major flap forms a first handle opening and the second major flap forms a second handle opening, the first and second handle openings are adapted to form a handle when the container is in a closed position.

4. The container of claim 1, wherein the first minor flap securing portion is a hinged opening, an opening, or a perforated cutout.

5. The container of claim 4, wherein the second minor flap securing portion is a hinged opening, an opening, or a perforated cutout.

6. The container of claim 1, wherein the first and second end securing portions of the first major flap are cutouts, perforated openings, hinged openings, outward protrusions, or combinations thereof.

7. The container of claim 6, wherein the third and fourth end securing portions of the second major flap are cutouts, perforated opening or hinged openings outward protrusions, or combinations thereof.

8. The container of claim 1, wherein the first major flap further comprises a fifth fold line that extends generally along a major axis thereof and the second major flap further comprises a sixth fold line that extends generally along a major axis thereof.

9. The container of claim 1, wherein the container comprises an alkenyl aromatic polymer.

10. The container of claim 9, wherein the container comprises a polystyrene foam.

11. The container of claim 1, wherein the container is rectangularly shaped.

12. The container of claim 1, wherein the rim is continuous.

13. The container of claim 1, wherein the thickness of the container is from about 50 mils to about 150 mils.

14. The container of claim 13, wherein the thickness of the container is from about 70 mils to about 100 mils.

15. A polymeric container, comprising:

an integrally-formed, non-foldable, body portion, the body portion comprising a bottom and a sidewall encompassing and projecting upwardly from the bottom to a top edge, the top edge defining an opening;

a rim encompassing and projecting laterally outwardly from the top edge of the sidewall;

a first minor flap integrally connected to the rim along a first fold line, the first minor flap forming a first minor flap securing portion;

a second minor flap integrally connected to the rim along a second fold line and located opposite of the first minor flap, the second minor flap forming a second minor flap securing portion;

a first major flap integrally connected to the rim along a third fold line and having a portion which overlies the rim when the container is in a closed position, the first major flap forming a first openable handle portion or first handle opening therein, a first end securing portion, and a second end securing portion; and a second major flap integrally connected to the rim along a fourth fold line and having a portion which overlies the rim when the container is in a closed position, the second major flap being located opposite of the first major flap, and forming a second openable handle opening or second handle opening therein, a third end securing portion, and a fourth end securing portion, the second openable handle portion or second handle opening of the second major flap being adapted to generally align with the first openable handle portion or first handle opening of the first major flap so as to form a handle when the container is in a closed position, wherein the first minor flap securing portion secures the first and third end securing portions, and the second minor flap securing portion secures the second and fourth end securing portions, and wherein the container is a polymeric container.

16. The container of claim 15, wherein the sidewall is continuous.

17. The container of claim 15, wherein the first major flap forms a first openable handle portion and the second major flap forms a second openable handle portion, the first and second openable handle portions are adapted to be removed so as is to form a handle when the container is in a closed position.

18. The container of claim 15, wherein the first major flap forms a first handle opening and the second major flap forms a second handle opening, the first and second handle openings are adapted to form a handle when the container is in a closed position.

19. The container of claim 15, wherein the first minor flap securing portion is a hinged opening, an opening, or a perforated cutout.

20. The container of claim 19, wherein the second minor flap securing portion is a hinged opening, an opening, or a perforated cutout.

21. The container of claim 15, wherein the first and second end securing portions of the first major flap are cutouts, perforated openings, hinged openings, outward protrusions, or combinations thereof.

22. The container of claim 21, wherein the third and fourth end securing portions of the second major flap are cutouts, perforated opening or hinged openings, outward protrusions, or combinations thereof.

23. The container of claim 15, wherein the first major flap further comprises a fifth fold line that extends generally along a major axis thereof and the second major flap further comprises a sixth fold line that extends generally along a major axis thereof.

24. The container of claim 15, wherein the container comprises an alkenyl aromatic polymer.

25. The container of claim 24, wherein the container comprises a polystyrene foam.

26. The container of claim 15, wherein the container is rectangularly shaped.

27. The container of claim 15, wherein the thickness of the container is from about 50 mils to about 150 mils.

28. The container of claim 27, wherein the thickness of the container is from about 70 mils to about 100 mils.

29. A polymeric container, comprising:

an integrally-formed, non-foldable, continuous body portion including a bottom and a sidewall projecting upwardly from the bottom to a top edge, the top edge defining an opening;

a rim encompassing the opening and projecting laterally outwardly from the top edge of the sidewall;

a first minor flap integrally connected to the outer periphery of the rim along a first fold line, the first minor flap forming a first minor flap securing portion;

a second minor flap integrally connected to the outer periphery of the rim along a second fold line and located opposite of the first minor flap, the second minor flap forming a second minor flap securing portion, the second minor flap being substantially identical to the first minor flap;

a first major flap integrally connected to the outer periphery of the rim along a third fold line, the first major flap forming a first openable handle portion or first handle opening therein, a first end securing portion, and a second end securing portion; and a second major flap integrally connected to the outer periphery of the rim along a fourth fold line and located opposite of the first major flap, the second major flap forming a second openable handle portion or second handle opening therein, a third end securing portion, and a fourth end securing portion, the second openable handle portion or second handle opening of the second major flap being adapted to generally align with the first openable handle portion or first handle opening of the first major flap so as to form a handle when the container is in a closed position, the second major flap being substantially identical to the first major flap, wherein the first minor flap securing portion secures the first and third end securing portions, and the second minor flap securing portion secures the second and fourth end securing portions, and wherein the container is a polymeric container.

30. The container of claim 29, wherein the second minor flap is identical to the first minor flap and the second major flap is substantially identical to the first major flap.

31. The container of claim 29, wherein the first major flap forms a first openable handle portion and the second major flap forms a second openable handle portion, the first and second openable handle portions are adapted to be removed so as to form a handle when the container is in a closed position.

32. The container of claim 29, wherein the first major flap forms a first handle opening and the second major flap forms a second handle opening, the first and second handle openings are adapted to form a handle when the container is in a closed position.

33. The container of claim 29, wherein the container comprises an alkenyl aromatic polymer.

34. The container of claim 29, wherein the thickness of the container is from about 50 mils to about 150 mils.

* * * * *